US010406386B2

(12) United States Patent
Beutler

(10) Patent No.: US 10,406,386 B2
(45) Date of Patent: Sep. 10, 2019

(54) RECOVERY DEVICE FOR AN AMUSEMENT RIDE

(71) Applicant: Jörg Beutler, Holzkirchen (DE)

(72) Inventor: Jörg Beutler, Holzkirchen (DE)

( * ) Notice: Subject to any disclaimer, the term of this patent is extended or adjusted under 35 U.S.C. 154(b) by 243 days.

(21) Appl. No.: 15/445,603

(22) Filed: Feb. 28, 2017

(65) Prior Publication Data

US 2017/0246484 A1 Aug. 31, 2017

(30) Foreign Application Priority Data

Feb. 29, 2016 (EP) ..... 16157957

(51) Int. Cl.

| | |
|---|---|
| ***A62B 3/00*** | (2006.01) |
| ***A63G 7/00*** | (2006.01) |
| ***B61B 5/02*** | (2006.01) |
| ***B61K 13/00*** | (2006.01) |

(52) U.S. Cl.

CPC ..... *A62B 3/00* (2013.01); *A63G 7/00* (2013.01); *B61B 5/02* (2013.01); *B61K 13/00* (2013.01)

(58) Field of Classification Search

CPC ... A62B 3/00; A63G 1/00; A63G 7/00; A63G 31/00; A63G 31/02; B61B 3/00

See application file for complete search history.

(56) References Cited

U.S. PATENT DOCUMENTS

| | | | | |
|---|---|---|---|---|
| 8,453,577 | B2 * | 6/2013 | Gordon | A63G 7/00 104/307 |
| 8,490,549 | B2 * | 7/2013 | Kitchen | A63G 21/10 104/53 |
| 2002/0103033 | A1 | 8/2002 | Stengel | |

FOREIGN PATENT DOCUMENTS

| | | | |
|---|---|---|---|
| CN | 204395421 | U | 6/2015 |
| DE | 202010008641 | U1 | 12/2010 |
| EP | 1721647 | A1 | 11/2006 |
| WO | 2015073998 | A1 | 5/2015 |

OTHER PUBLICATIONS

Aug. 17, 2016, Extended European Search Report from the European Patent Office in European Patent Application No. 16157957.8-1658, which this U.S. application claims the benefit of priority.

* cited by examiner

*Primary Examiner* — Robert J McCarry, Jr.
(74) *Attorney, Agent, or Firm* — Kolitch Romano LLP

(57) ABSTRACT

A fairground ride may include a support structure, at least one vehicle having a passenger receptacle, and at least one guideway which is attached to the support structure and forms a circuit, wherein the guideway is adapted to guide the vehicle along the circuit. The fairground ride may also include at least one drive member which is adapted to move the vehicle along the circuit; and at least one recovery apparatus, which has an operating range. The guideway may be disposed at least section-wise on a substantially vertical area, each point of the normal vector of which is perpendicular to the vertical axis of the support structure, and the operating range of the recovery apparatus may substantially cover the vertical area.

20 Claims, 6 Drawing Sheets

RECOVERY DEVICE FOR AN AMUSEMENT RIDE

CROSS-REFERENCE TO RELATED APPLICATION

This application claims priority to European Patent Application No. EP16157957.8, filed Feb. 29, 2016, which is hereby incorporated by reference.

BACKGROUND

Fairground rides, e.g., roller coasters, are known in which one or more vehicles is/are guided along a circuit which is disposed on a tower-like support construction. To enhance the enjoyment of the ride, the goal of the designers of roller coasters is to provide the highest-possible number of steep and fast circuit sections. This can be facilitated, for example, with steeply ascending or descending circuit sections, and in extreme cases even vertical circuit sections, loopings or similar configurations.

The problem with such fairground rides is that in the event of a breakdown—the more spectacular the design of the circuit is—the requisite, comprehensive and, above all, rapid recovery of the passengers can be ensured either not at all or only with great effort since generally, especially in the case of self-propelled vehicles, the necessary access needs to be installed in such a way that every position on the circuit can be reached.

SUMMARY

One or more embodiments of the present application relates to a fairground ride having a support structure comprising at least one vehicle having a passenger receptacle; at least one guideway which is attached to the support structure and forms a circuit, wherein the guideway is suitable for guiding the vehicle along the circuit; at least one drive member suitable for moving the vehicle along the circuit; and at least one recovery and rescue apparatus for recovery, rescue and/or maintenance purpose.

An object of one or more embodiments of the present disclosure is to provide a fairground ride in which the circuit provides a spectacular route and which at the same time comprises a recovery apparatus which reaches almost every section of the circuit.

In one or more embodiments of the present disclosure, a fairground ride has a tower-like support structure, which comprises at least one vehicle, which has a passenger receptacle and at least one guideway which is attached to the support structure and forms a circuit, wherein the guideway is suitable for guiding the vehicle along the circuit. In addition, the fairground ride has at least one drive member which is suitable for moving the vehicle along the circuit, and at least one recovery apparatus with an operating range (action radius). The guideway is disposed at least section-wise on a substantially vertical area, each point of the normal vector of the vertical area is perpendicular to the vertical axis of the support structure, and the operating range of the recovery apparatus substantially covers the vertical area.

In one or more embodiments of the present disclosure, viewed from above or below, the (virtual) vertical axis intersects or passes through, for example, the area of the support structure which forms the (projected) top area and/or base area, for example in a central area, e.g., in the centre of gravity of the projected surface of the top area or the base area. The vertical axis is plumb with or perpendicular to the horizontal surface of the earth.

In one or more embodiments of the present disclosure, the support structure is vertically oriented and can form a tower, or a tower-like building structure (e.g., in the form of scaffolding) or any other building, e.g., a high-rise building or a pyramidal building, etc. The support structure may be steel, but can also be suitable building materials, such as concrete, etc. The support structure can be permanently mounted in a fixed position. Alternatively, the support structure can be designed for temporary assembly and disassembly, e.g., for transporting the fairground ride to different locations.

In one or more embodiments of the present disclosure, the vehicle is suitable for accommodating at least one passenger. Conceivable in this regard is an arrangement of at least two passengers side by side and/or an arrangement of one behind the other. The passenger receptacle has a corresponding receiving apparatus and can be, among other things, an open seat construction or a closed cabin with corresponding ways for securing the passengers.

In one or more embodiments of the present disclosure, the guideway may be at least one rail or two parallel guided rails, by way of which the vehicle is held and guided along the circuit thus formed. Also conceivable is a guide structure which comprises a corresponding receptacle for a chassis (frame) of the vehicle, e.g., a trough structure. The guideway is attached to the support structure. All conventional and known attachment methods can be used in this connection, e.g., screwing, welding, riveting, etc. The attachment can be permanent or only temporary, e.g., for when the fairground ride is operated only intermittently and has to be assembled and disassembled repeatedly. The guideway can be erected at the same time as the support structure. Alternatively, the guideway can also be retrofitted to an existing building structure. In one or more embodiments of the present disclosure, the guideway is formed into a closed circuit, as a result of which the vehicle or vehicles can travel in a loop. Alternatively, the circuit can be guided merely finitely (e.g., on just one side of the support structure), with the vehicle or vehicles travelling point to point. The vehicle can be guided from either the bottom or the top by the guideway. Guiding from the top, or from above the passenger receptacle, increases the thrill because the circuit disappears from the direct field of vision and therefore from the passenger's perception, and the impression of free-floating movement is suggested. Also conceivable is a lateral guiding of the vehicle.

In one or more embodiments of the present disclosure, the guideway is arranged at least section-wise on a substantially vertical area, each point on the normal vector of which is perpendicular to the vertical axis of the support structure. The vertical area need not be completed, but may be determined by the underlying support structure, which defines a vertical envelope surface. The term vertical area can comprise, in addition to the plumb line per definitionem (90 degrees), tolerance angles of up to +/−10 degrees (i.e. the angle may be between 80 and 100 degrees). The circuit formed by the guideway can be substantially a straight line or have a winding structure.

In one or more embodiments of the present disclosure, the drive member for moving the vehicle can be located on the vehicle itself (actively driven vehicle) or at corresponding points on the circuit (passively driven vehicle), primarily on slopes or during the ascent. All conventional and conceivable drive members are conceivable in this regard.

In one or more embodiments of the present disclosure, the recovery apparatus serves to provide access to the circuit from the outside and is so designed, and has an operating range which is so composed that almost all areas of the circuit can be reached. In this way, the recovery of passengers or vehicles can be effected that have come to a standstill in an area of the circuit due to a malfunction.

In one or more embodiments of the present disclosure, the operating range/action radius of the recovery apparatus covers the vertical area. This means that substantially every location of the circuit of the vertical area and/or every location of the vertical area is accessible by the recovery apparatus. e.g., the cage/platform may be vertically and/or horizontally moveable in order to reach said locations; or there may be multiple platforms arranged side-by-side being independently vertically moveable; or there may be a broad cage or platform which is vertically moveable and which is substantially as broad as the vertical area. The shape of the cage/platform may be adapted to the shape of the vertical area.

In one or more embodiments of the present disclosure, the type of vehicle movement generated by the drive member is an acceleration and/or a deceleration.

In one or more embodiments of the present disclosure, acceleration takes place during ascent of the vehicle(s) and deceleration during descent. In the latter case, energy can be recovered due to deceleration (energy recovery).

In one or more embodiments of the present disclosure, the drive member comprises a gear connection, a cable connection, a chain connection, a friction wheel drive or a linear drive.

Through the aforementioned and customary positive or non-positive connections, the force provided shall be converted as completely as possible into the corresponding forms of movement.

In one or more embodiments of the present disclosure, the vehicle has a chassis (frame) which is disposed movably, for example rotatably, relative to the passenger receptacle.

In one or more embodiments of the present disclosure, and in order to realise a closed circuit with ascent and descent and to prevent the vehicle from assuming an upside-down position during a changeover from an ascent to a descent, the vehicle is in one or more embodiments of the present disclosure disposed rotatably on the chassis (frame). In this way, unwanted upside-down positions can be avoided. In addition, with a rotatably mounted chassis (bogie), which may be mounted below or above the passenger receptacle, compensation or damping commensurate with the gravitational or weight force of the vehicle relative to the circuit can be achieved. In addition, the vehicle can swivel out due to centrifugal forces caused by curvilinear movements.

In one or more embodiments of the present disclosure, the circuit is guided at least section-wise substantially vertically parallel with the vertical axis of the support structure.

In this regard, in the extreme case at least a section of the circuit may extend along a straight line (therefore perpendicularly to or plumb with the 90° angle to the horizontal, and parallel with the vertical axis of the support structure). In this regard, an angular deviation of up to +/−10 degrees from the vertical axis of the support structure (i.e. the angle may be between 80 and 100 degrees) is to be understood as vertical.

In one or more embodiments of the present disclosure, the circuit is guided substantially spirally upwards and/or downwards about the vertical axis of the support structure.

In one or more embodiments of the present disclosure, long vertical sections during the ascent can be avoided via such winding structures, or curves and waves. On one hand, this has the effect of creating a longer circuit, thereby increasing the ride time and the enjoyment of the ride. On the other, the energy supply can be better distributed and the load on the drive members can be reduced because fewer peak loads occur (in the event that, e.g., several vehicles ascend simultaneously) and the thermal load on the drive members is reduced.

In one or more embodiments of the present disclosure, the recovery apparatus is designed for recovery, rescue and/or circuit maintenance.

In one or more embodiments of the present disclosure, and due to the fact that the recovery apparatus can reach nearly every section of the circuit or the vertical outer area of the tower-like support structure, the apparatus is suitable not only for recovery in the event of a malfunction but also for maintenance work on the circuit and the support structure.

In one or more embodiments of the present disclosure, the recovery apparatus comprises an attachment apparatus, which is attached to the support structure, a platform and/or a cage, and a support device for the purpose of providing support for and travel of the platform along a travel path, wherein the travel path is disposed vertically along the height of the support structure and the platform or cage can be moved along the travel path. In addition, the cage or platform may be configured to be horizontally moveable. So the movement may have a vertical and (possibly interfering) horizontal component.

In one or more embodiments of the present disclosure, the recovery apparatus is attached to the support structure via the attachment apparatus by way of conventional and all conceivable attachment methods. The platform, or the cage, extends across the width of the support structure and is suitable on one hand for accommodating rescue personnel in the event of a malfunction or personnel in the event of maintenance and repair, and on the other hand for accommodating the rescued passengers. The cage is connected to a support device, as a result of which the cage can travel along the vertical axis of the support structure on a (substantially vertical) travel path. As a result, substantially all areas of the circuit on one plane along the travel path can be reached.

In one or more embodiments of the present disclosure, the attachment apparatus can comprise a jib or cantilever beam which is disposed at the upper edge area of the support construction and projects at least partially outwards over the edge of the top of the support construction. In this way, the recovery apparatus can be attached to the attachment apparatus, e.g., by one or more support cables, such that it can travel vertically.

In one or more embodiments of the present disclosure, the attachment apparatus of the recovery apparatus is disposed on the top and/or on the bottom of the support structure.

In one or more embodiments of the present disclosure, the recovery apparatus can be attached to the top of the support structure, in accordance with which the travel path formed by the support device runs from the top, i.e. vertically, to the bottom. Alternatively, in the case of attachment to the bottom of the support structure, the travel path can extend vertically from the bottom to the top of the support structure. Cumulative attachment to the top and bottom of the support structure is also possible.

In one or more embodiments of the present disclosure, the support device of the recovery apparatus comprises at least one cable (e.g., steel cable) and/or at least one tube and/or a support rod (telescope).

In one or more embodiments of the present disclosure, conventional cables and tubes as well as rails and racks and the like can be used. There may be a duplicate design, e.g., through two parallel guided tubes, on account of the increased lateral stability and from safety aspects (e.g., prevention of material fatigue).

In one or more embodiments of the present disclosure, the recovery apparatus has a drive member which is suitable for moving the platform or the cage along the travel path of the support device.

In one or more embodiments of the present disclosure, the drive member (e.g., motor) can be attached to the platform or to the cage itself. Alternatively, the drive can also be attached to the support structure in the area of the attachment to the top or bottom (e.g., motor-driven cable winches).

In one or more embodiments of the present disclosure, the attachment apparatus of the recovery apparatus can be moved around the perimeter of the top of the support structure and/or around the bottom of the support structure or at least along sections thereof.

In this regard, the attachment apparatus is guided along the perimeter of the support structure inter alia by way of corresponding apparatuses for guiding, e.g., rails, etc. As a result of the additional movement, the linear movement along the height of the support structure can be overlaid with a horizontal movement. The end result is that every area and every side of the support structure can be reached. This is particularly advantageous when the circuit is guided along the sides of the support structure or a plurality of circuits are used.

In one or more embodiments of the present disclosure, the recovery apparatus comprises a drive apparatus for moving the recovery apparatus along the perimeter of the support structure and/or for moving the platform along the travel path of the support device.

In line with the above-described drive for movement along the travel path, a further or the same drive member can effect the movement along the perimeter of the support structure.

In one or more embodiments of the present disclosure, the recovery apparatus has an extendable extension.

In one or more embodiments of the present disclosure, the extension serves to extend the platform's effective range in order that sections of the circuit which are somewhat further inside and outside the actual travel path may be reached with the platform. The vertical projection of the travel path then does not yield a point in the horizontal plane, but rather a line, the length of the line corresponding to the maximum travel distance L of the extension. Considering that the cage/platform has a width B, the vertical projection of the operating range does not yield a line of length B in the horizontal plane, but rather a rectangular area, the length L of which corresponds to the maximum travel distance of the extension and the width of it is B. I.e. the travel space would be a volume of width B, length L and height corresponding to the vertical travel distance of the cage/platform.

In one or more embodiments of the present disclosure, a fairground ride system includes at least two fairground rides, wherein the circuits of the fairground rides run on one or more horizontal and/or one or more vertical planes of the at least two support structures.

In one or more embodiments of the present disclosure, in support structure, fairground rides with a plurality of operating units and a plurality of operating planes (or operating spaces) can also be attached. For example, one operating unit can be located on the outside of the tower-like support structure and a further operating unit can be located on the inside.

DETAILED DESCRIPTION

Figure 1:
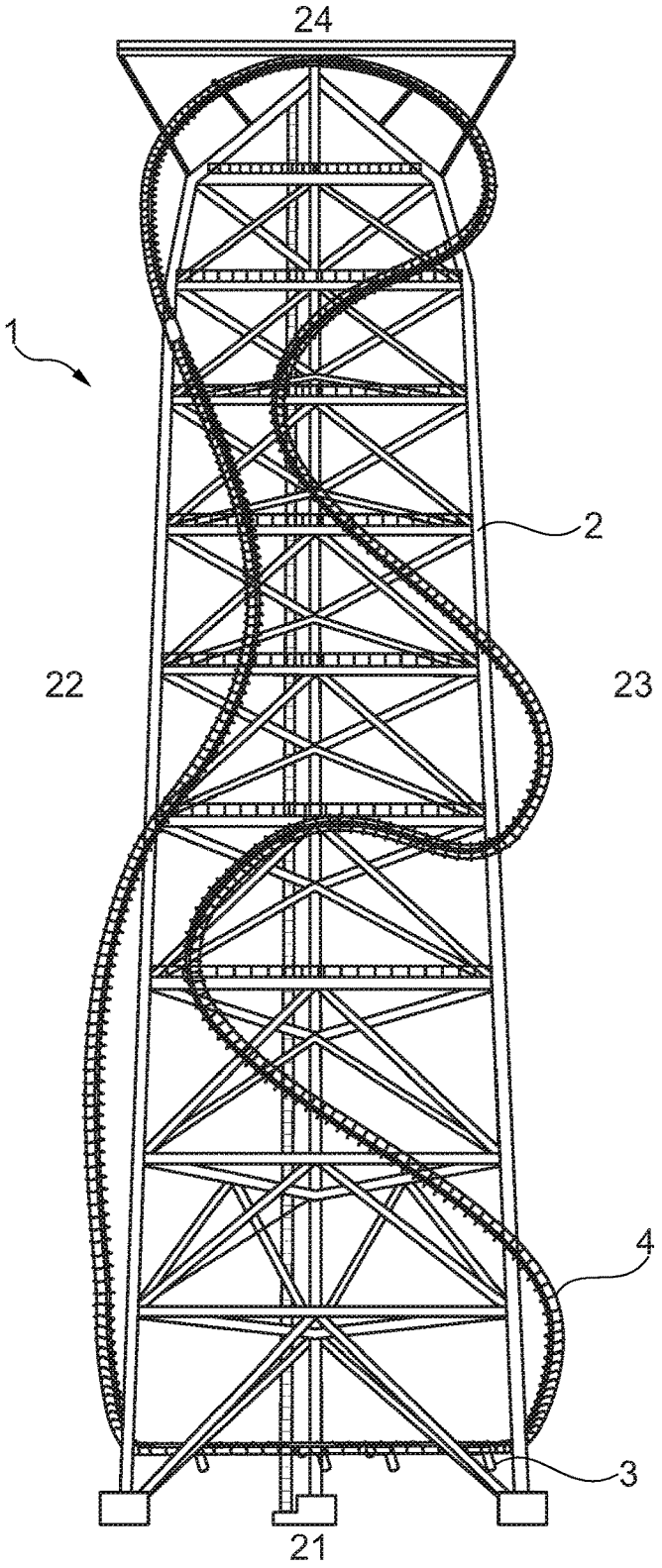
FIG. 1 is a representation of an embodiment of a fairground ride with a tower-like support structure comprising steel members, to which a guideway is attached. The guideway includes two parallel guide rails, as well as a support rail and support structure (e.g., connecting bars between the guide rails and the support rail) and forms a circuit. The closed circuit winds its way upwards on the right side of the illustrated view, and essentially vertically downwards on the left side. The vehicles are guided from above the passenger receptacle by the guideway. The recovery apparatus is attached to the top of the support structure.

The present disclosure is explained below with reference to an embodiment. FIG. 1 shows an overall view of a fairground ride 1 with a tower-like support structure 2. The tower of the support structure 2 includes a truss structure, which is formed from individual steel members. In the vertical direction, the support structure 2 is configured so as to taper towards the top 24. The guideway 4 in the form of two parallel-guided guide rails and a support rail with support structure is attached to the support structure 2. The circuit formed by the guideway 4 is a closed circuit. In this regard, the circuit begins in a station area for the purpose of passenger entry/exit (not shown) on the bottom 21 of the support structure and executes an ascent in a multiply winding structure on the right side 23 to the top 24 of the support structure 2, where it transitions into an almost vertical downwards stretch on the left side 22. Guided along the circuit by way of the guideway 4 are vehicles 3, which serve to accommodate passengers. In the present example, guiding of the vehicles 3 is effected from above the passenger receptacle. Attached to the top 24 of the tower structure is the recovery apparatus 5, which is shown in further detail in FIG. 2.

Figure 2:
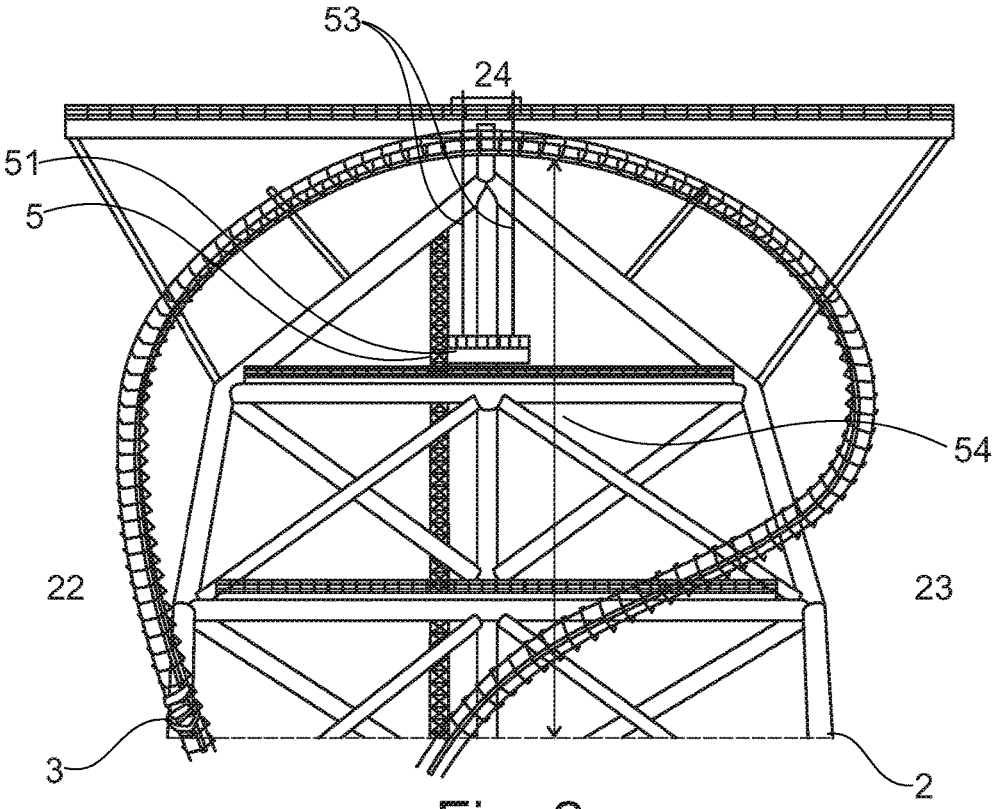
FIG. 2 is a representation of an embodiment of a recovery apparatus on the tower-like support structure. The recovery apparatus is attached to the top of the support structure. Two parallel guided cables form a support device to which a platform is attached. The support device allows for movement of the platform along a vertical travel path along the vertical plane of the support structure.
Figure 3:
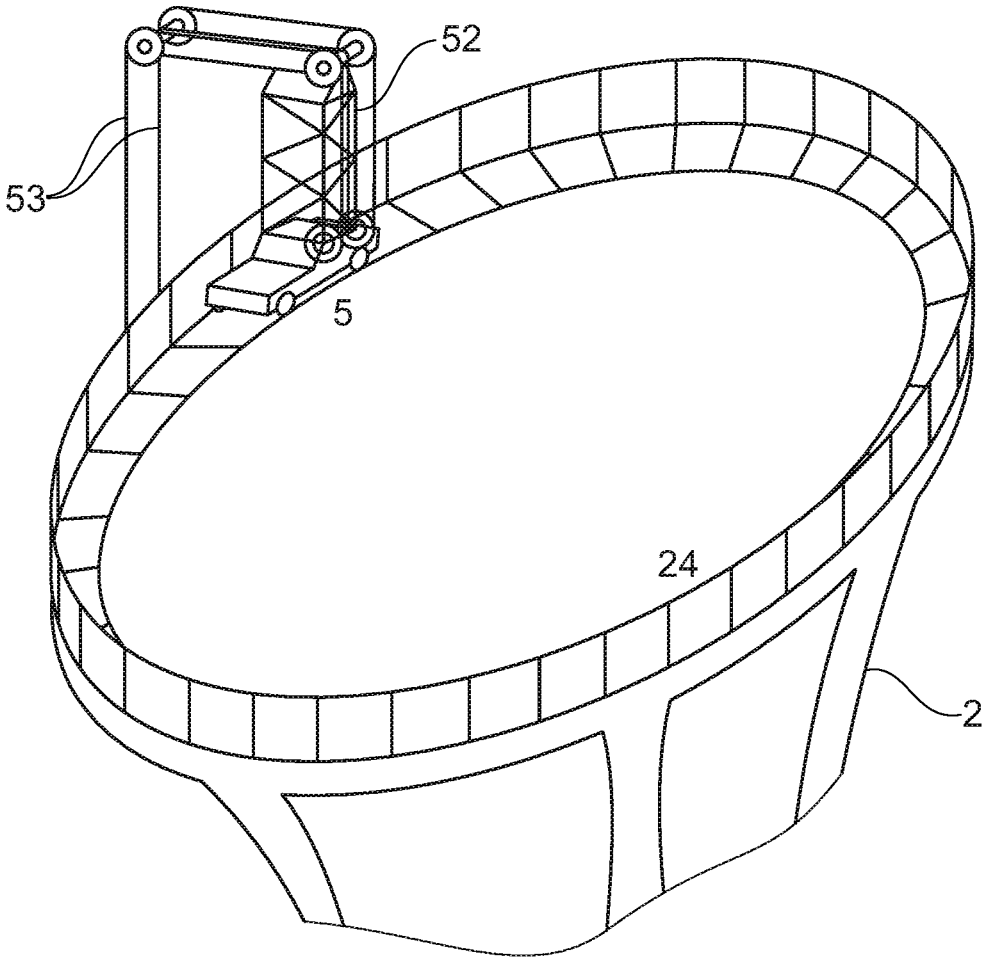
FIG. 3 is a representation of an embodiment of a recovery device, which is attached to the top of the support structure by way of the attachment apparatus. The attachment apparatus is movable along the perimeter of the surface of the support structure.

FIG. 2 shows the recovery apparatus 5, which is attached to the top 24 of the support structure 2 by an attachment apparatus 52 (see FIG. 3). Two parallel guided cables form a support device 53, to which is attached a platform 51 or a cage. The support device 53 is so designed and movable that it is possible for the platform or the cage to move along a travel path 54 along the vertical plane of the support structure 2.

FIG. 3 shows an example of the attachment apparatus 52 of the recovery apparatus 5, which is disposed on the top 24 of the support structure 2. The attachment apparatus 52 is movable around the perimeter of the surface 24 of the support structure 2, as a result of which every side of the support structure 2 can be reached.

Figure 4A:
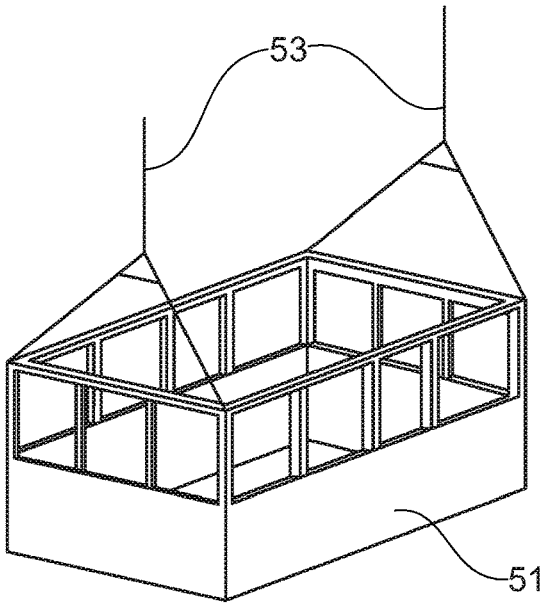
FIG. 4A is a representation of an embodiment of a platform of the recovery apparatus. The platform is attached, by two cables at each of its short sides, to the support device.
Figure 4B:
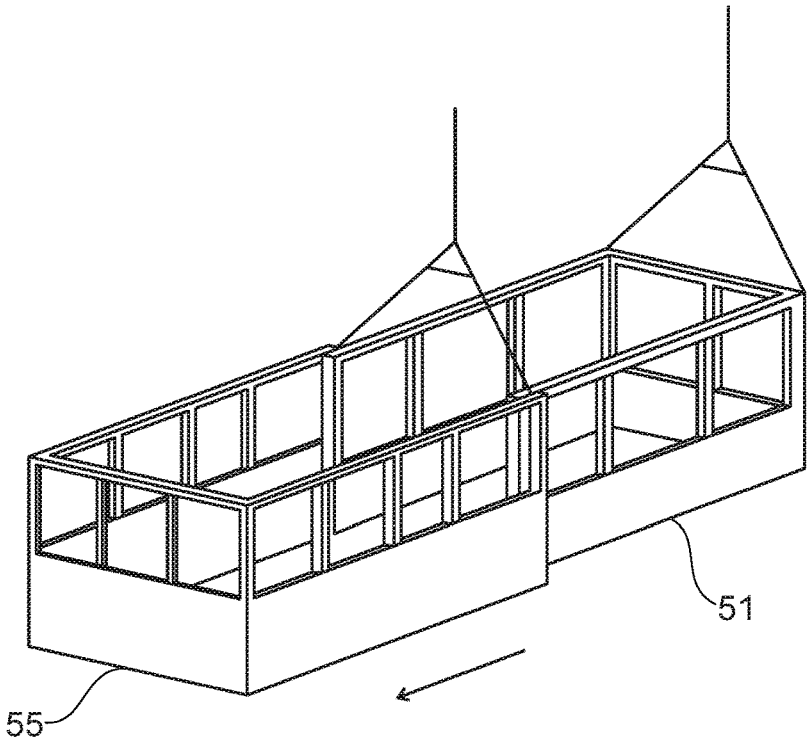
FIG. 4B is a representation of an embodiment of a platform of the recovery apparatus with extension. The extension is extendable along the short side of the platform and enlarges the area of the platform in this way when being extended.

FIGS. 4A and 4B show the platform 51 of the recovery apparatus 5. FIG. 4A shows the platform 51, each of the short sides of which is attached to the support device 53 by two cables. In accordance with FIG. 4B, the platform 51, or the cage, has an extension 55. The extension 55 is extendable along the short side of the platform 51 and thus enlarges the area of the platform 51. Alternatively, extendability along the long side of the platform 51 is also possible. In this way, the effective range that can be reached by the platform is increased.

FIGS. 5A to 5D show different configurations of the circuit, which is formed by the guideway 4 and is disposed in a substantially vertical area. In this regard, two rails are parallel guided on a support rail. The support rail is connected to the support device 53.

Figure 5A:
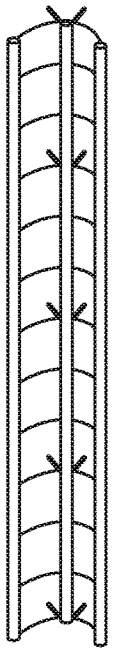
FIG. 5A is a representation of an embodiment of a lateral view of the circuit of the guide structure in the form of a straight line.

FIG. 5A shows a straight stretch of circuit. In this regard, only one movement of the vehicle or vehicles 3 in the form of a round-trip, e.g., from the bottom 21 of the support device 53 to the top 24, is possible.

Figure 5B:
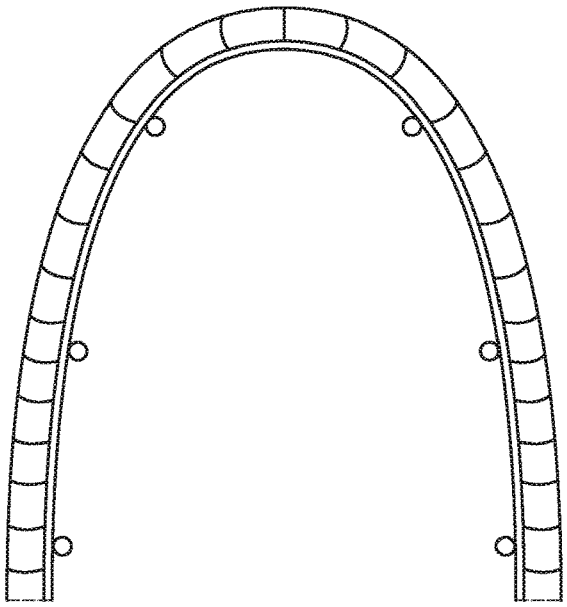
FIG. 5B is a representation of an embodiment of a plan view of the circuit of the guide structure in the form of a wave.

FIG. 5B shows a plan view of the circuit configuration in the form of a wave.

Figure 5C:
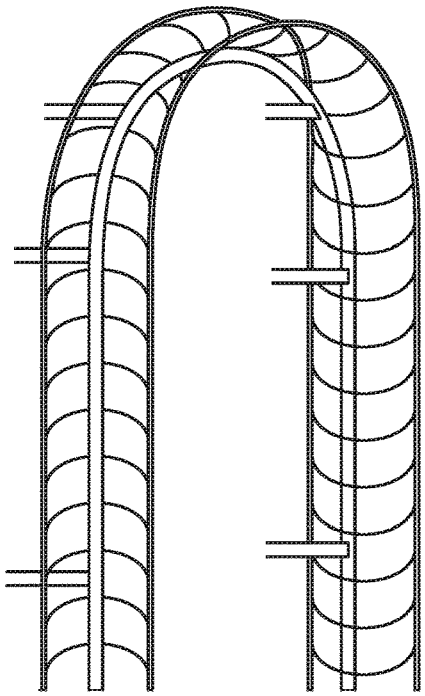
FIG. 5C is a representation of an embodiment of a lateral view of the circuit of the guide structure in the form of a wave.

FIG. 5C shows a perspective side view of the waveform of the circuit.

Figure 5D:
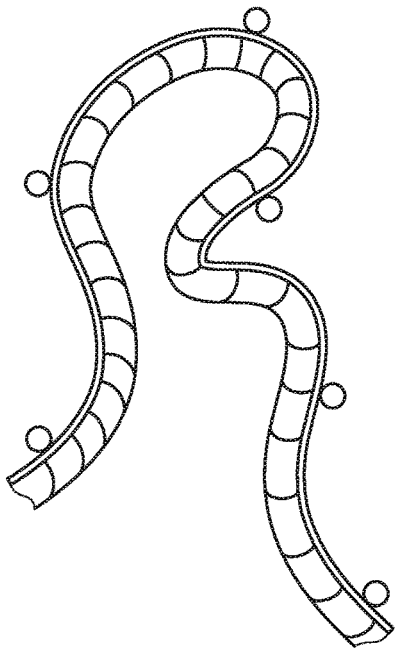
FIG. 5D is a representation of an embodiment of a plan view of a convoluted shape of the circuit.

FIG. 5D shows a plan view of a convoluted form of the circuit.

In FIGS. 5B and 5D the vertical area of the operating range does not have to be a plane, but can also include vertically arranged curved areas, e.g., in the form of a vertical cylindrical wall, a wave shape which is configured of vertically arranged wall sections (FIG. 5B) or in the form of a convoluted shape which is configured of vertically arranged wall sections (FIG. 5D).

In one or more embodiments, a fairground ride has a tower-like support structure with at least one vehicle and a guideway, which is attached to the support structure and forms a circuit and which is suitable for guiding the vehicle. A drive member is also provided, which is suitable for moving the vehicle along the circuit, as well as at least one recovery apparatus with an operating range, wherein the guideway is at least section-wise disposed on a substantially vertical area and the operating range of the recovery apparatus substantially covers the vertical area.

The present disclosure may include one or more of the following concepts:

A. A fairground ride (1) comprising: a support structure (2); at least one vehicle (3) having a passenger receptacle (31); at least one guideway (4) which is attached to the support structure (2) and forms a circuit, wherein the guideway (4) is suitable for guiding the vehicle (3) along the circuit; at least one drive member which is suitable for moving the vehicle (3) along the circuit; and at least one recovery apparatus (5), which has an operating range, wherein the guideway (4) is disposed at least section-wise on a substantially vertical area, each point of the normal vector of which is perpendicular to the vertical axis of the support structure (2), and the operating range of the recovery apparatus substantially covers the vertical area.

B. The fairground ride (1) in accordance with paragraph A, wherein the movement of the vehicle (3) generated by the drive member is an acceleration and/or a deceleration.

C. The fairground ride (1) in accordance with paragraph A, wherein the drive member comprises a gear connection, a cable connection, a chain connection, a friction wheel drive or a linear drive.

D. The fairground ride (1) in accordance with paragraph A, wherein the vehicle (3) has a chassis which is disposed movably, especially rotatably, relative to the passenger receptacle (31).

E. The fairground ride (1) in accordance with paragraph A, wherein the circuit is guided at least section-wise substantially vertically parallel with the vertical axis of the support structure.

F. The fairground ride (1) in accordance with paragraph A, wherein the circuit is guided substantially spirally upwards and/or downwards about the vertical axis of the support structure (2).

G. The fairground ride (1) in accordance with paragraph A, wherein the recovery apparatus (5) is especially designed for recovery and/or circuit maintenance.

H. The fairground ride (1) in accordance with paragraph A, wherein the recovery apparatus (5) comprises an attachment apparatus (52), which is attached to the support structure (2), at least one of a platform (51) and a cage, and a support device (53) for the purpose of providing support for and travel of the platform along a travel path, wherein the travel path (54) is disposed especially vertically along the height of the support structure (2) and the platform (51) can be moved along the travel path (54).

I. The fairground ride (1) in accordance with paragraph A, wherein the attachment apparatus (52) of the recovery apparatus (5) is disposed on the top (24) or on the bottom (21) of the support structure (2), or on the top (24) and on the bottom (21) of the support structure (2).

J. The fairground ride (1) in accordance with paragraph H, wherein the support device (53) of the recovery apparatus (5) comprises at least one of a cable, a tube, rails, and a support rod.

K. The fairground ride (1) in accordance with paragraph A, wherein the recovery apparatus (5) has a drive member which is suitable for moving the platform (51) or the cage along the travel path (54) of the support device (53).

L. The fairground ride (1) in accordance with paragraph H, wherein the attachment apparatus (52) of the recovery apparatus (5) can be moved around the perimeter of the top (24) of the support structure (2) and around the bottom (23) of the support structure (2), respectively.

M. The fairground ride (1) in accordance with paragraph A, wherein the recovery apparatus (5) comprises a drive apparatus for moving the recovery apparatus (5) along the perimeter of the support structure (2) or for moving the platform (51) along the travel path (54) of the support device (53).

N. The fairground ride (1) in accordance with paragraph A, wherein the recovery apparatus (5) comprises a drive apparatus for moving the recovery apparatus (5) along the perimeter of the support structure (2) and for moving the platform (51) along the travel path (54) of the support device (53).

O. The fairground ride (1) in accordance with paragraph A, wherein the recovery apparatus (5) has an extendable extension (55).

P. A fairground ride system comprising at least two fairground rides (1) in accordance with paragraphs A or H, wherein the circuits of the fairground rides (1) run on one or more vertical planes of the at least two support structures (2).

What is claimed is:

1. A fairground ride comprising:

a support structure;

at least one vehicle having a passenger receptacle;

at least one guideway which is attached to the support structure and is adapted to guide the vehicle;

at least one drive member which is adapted to move the vehicle along the guideway; and at least one recovery apparatus comprising a platform or a cage;

wherein the guideway is disposed at least section-wise on a substantially vertical area, each point of a normal vector of which is perpendicular to a vertical axis of the support structure; and wherein the platform or cage of the recovery apparatus is vertically movable along the substantially vertical area, and an operating range of the recovery apparatus substantially covers the substantially vertical area.

2. The fairground ride of claim 1, wherein a movement of the vehicle generated by the drive member is an acceleration and/or a deceleration.

3. The fairground ride of claim 1, wherein the drive member comprises a gear connection, a cable connection, a chain connection, and one of a friction wheel drive or a linear drive.

4. The fairground ride of claim 1, wherein the vehicle has a chassis which is disposed movably relative to the passenger receptacle.

5. The fairground ride of claim 1, wherein the vehicle has a chassis which is disposed rotatably relative to the passenger receptacle.

6. The fairground ride of claim 1, wherein the guideway is guided at least section-wise substantially vertically parallel with the vertical axis of the support structure.

7. The fairground ride of claim 1, wherein the guideway is guided substantially spirally upwards and/or downwards about the vertical axis of the support structure.

8. The fairground ride of claim 1, wherein the recovery apparatus is configured for recovery and/or circuit maintenance.

9. The fairground ride of claim 1, wherein the recovery apparatus comprises an attachment apparatus, which is attached to the support structure, and a support device configured to provide support for and travel of the platform or cage along a travel path, wherein the travel path is disposed vertically along a height of the support structure and the platform is movable along the travel path.

10. The fairground ride of claim 9, wherein the attachment apparatus of the recovery apparatus is disposed on a top or on a bottom of the support structure.

11. The fairground ride of claim 10, wherein the support device of the recovery apparatus comprises at least one of a cable, a tube, rails, and a support rod.

12. The fairground ride of claim 9, wherein the attachment apparatus of the recovery apparatus is disposed on the top and on the bottom of the support structure.

13. The fairground ride of claim 12, wherein the support device of the recovery apparatus comprises at least one of a cable, a tube, rails, and a support rod.

14. The fairground ride of claim 9, wherein the attachment apparatus of the recovery apparatus is movable around a perimeter of a top of the support structure and around a bottom of the support structure, respectively.

15. The fairground ride of claim 1, wherein the recovery apparatus has a drive member configured to move a platform or a cage along a travel path of a support device.

16. The fairground ride of claim 1, wherein the recovery apparatus comprises a drive apparatus configured to move the recovery apparatus along a perimeter of the support structure or to move a platform along a travel path of a support device.

17. The fairground ride of claim 1, wherein the recovery apparatus comprises a drive apparatus configured to move the recovery apparatus along a perimeter of the support structure and configured to move a platform along a travel path of a support device.

18. The fairground ride of claim 1, wherein the recovery apparatus has an extendable extension.

19. A fairground ride system comprising at least two fairground rides in accordance with claim 1, wherein the guideways of the at least two fairground rides run on one or more vertical planes of the at least two support structures.

20. A fairground ride system comprising at least two fairground rides in accordance with claim 9, wherein the circuits of the fairground rides run on one or more vertical planes of the at least two support structures.

* * * * *